United States Patent [19]

Focke et al.

[11] Patent Number: 4,930,292

[45] Date of Patent: Jun. 5, 1990

[54] APPARATUS FOR WRAPPING ARTICLES WITH A FILM WEB

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 232,201

[22] Filed: Aug. 15, 1988

[30] Foreign Application Priority Data

Aug. 14, 1987 [DE] Fed. Rep. of Germany ..... 3727076

[51] Int. Cl.[5] ..... B65B 13/04

[52] U.S. Cl. ..... 53/588; 53/550; 53/263; 53/556

[58] Field of Search ..... 53/399, 441, 556, 588, 53/210, 540, 550, 575, 263; 100/13

[56] References Cited

U.S. PATENT DOCUMENTS 3,377,771 4/1968 Schmidt, Sr. ..... 53/262 X
4,553,374 11/1988 Lancaster ..... 53/556 X
4,658,569 4/1987 Hanagata ..... 53/550
4,711,069 12/1987 Silbernagel ..... 53/588
4,723,393 2/1988 Silbernagel ..... 53/556

*Primary Examiner*—John Sipos
*Attorney, Agent, or Firm*—Sughrue, Mion, Zinn, Macpeak & Seas

[57] ABSTRACT

Continuously transported groups (21) of articles (20), in particular packages, are wrapped by means of wrapping with a continuous film web 23 (stretch film) and held together thereby. The article groups (21) are conveyed by an inward conveyor (31) to a winding station (25) having a winding unit (26), and after being wrapped with their wrapping (24) are transported away by an outward conveyor (32). In the region of the winding station (25) the article groups (21) are held, conveyed and in particular fixed in their relative position by a support member (33) which consists of at least one horizontal or vertical support wall. The support wall or support walls are arranged in the region between the articles (20) of one article group (21), in other words in the region of mutually facing surfaces of the articles. As a result, the film web 23 is directly wound around the articles.

17 Claims, 10 Drawing Sheets

APPARATUS FOR WRAPPING ARTICLES WITH A FILM WEB

BACKGROUND OF THE INVENTION

The invention relates to an apparatus for encasing articles by wrapping with a film web which, during the advance of the articles, is passed around the articles with overlapping of its edges, it being possible to feed the articles as article groups comprising two or more articles arranged adjacent to one another and/or one above the other by means of an inward conveyor to a winding unit having a support member for the articles, and it being possible to transport the wrapped article groups with continuous wrapping through an outward conveyor arranged downstream of the winding unit.

The wrapping of articles, in particular (relatively large) packages or groups of packages, with a film web which is wound around the articles during the advance of the latter is a simple, effective way of packaging the articles or holding them together in groups. In this arrangement the film web consists of a so-called stretch film which can be shrunk subsequently.

An apparatus of the type mentioned initially is disclosed by German Patent No. 3,338,036. The articles are supported and transported in the region of the winding unit by upper and lower belt conveyors. These conveyors are also wrapped by the film web. When the wrapped articles are passed to the outward conveyor, the film web or the resulting wrapping of the articles runs off the belt conveyors.

The wrapping with the film web of the upper and lower belt conveyors which receive the articles between them is perceived as disadvantageous since the conveyors do not come into contact with the articles to be wrapped until after leaving the winding region.

SUMMARY OF THE INVENTION

The object of the invention is to develop and improve the apparatus mentioned initially in a manner such that the articles which are properly supported in the winding region and—in the case of article groups—are retained in their formation can be directly wrapped with film web.

In order to achieve this object, the apparatus according to the invention is one wherein the articles of an article group comprising two or more articles are supported in the region of the winding unit by one or more stationary support members in the region between the articles—between mutually facing article surfaces.

The apparatus according to the invention therefore dispenses with external belt conveyors or other support members in the region of the winding unit for supporting and transporting the articles. Instead, the latter are supported and retained in their group formation by the fact that (thin) support members are arranged between the articles of an article group. The articles are thus directly wrapped with the film web on their outer sides. At the ends of the support members, the articles are guided together in the transverse direction, overcoming a gap corresponding to the width or thickness of the support members.

The support member may be designed in various ways. In the simplest embodiment, the support member comprises a horizontal (for each pair of articles lying one above the other) or vertical (for two articles lying adjacent to one another) support wall. This is preferably designed so that the conveying effect on the articles which is primarily produced by the continuously wound film web is supported. The support wall can hence, according to the invention, possess lateral belt conveyors whose outer conveying lengths each bear on the facing surfaces of the packaging. Belt conveyors can be driven or free-running.

Alternatively, the support wall can possess a plurality of support rolls or (thin) support rollers arranged at a distance from one another, some of which bear on one side of the packaging and others on the other. The support rollers rotate freely with the advance of the articles.

According to a further alternative, the support walls of the support member are designed as sliding walls with correspondingly prepared surfaces along which the articles are slidingly moved.

In the case of article groups comprising a plurality of articles arranged adjacent to one another and/or one above the other, the support member comprises a corresponding number of support walls arranged cruciformly or in another manner. These can be correspondingly designed and possess (driven) belt conveyors. However, an advantageous solution for the purposes of the invention is one wherein individual, in particular load-bearing, support walls are designed to produce a conveying effect, thus for example possessing belt conveyors, whereas other less stressed support walls act as sliding walls.

The support member or parts thereof extends or extend, according to a further proposal of the invention, into the region of the inward conveyor and of the outward conveyor, the support walls being designed in a manner such that they become thinner in the region of the inward conveyor and of the outward conveyor. As a result, the articles of an article group lying adjacent to one another are guided together gradually in a transverse direction after leaving the winding region.

Further features of the invention relate to the design of the support member and to additional conveying aids and to the design of the inward conveyor and of the outward conveyor.

Exemplary embodiments of the invention are explained in detail below with reference to the drawings, in which:

DETAILED DESCRIPTION OF PREFERRED EMBODIMENTS

Figure 1:
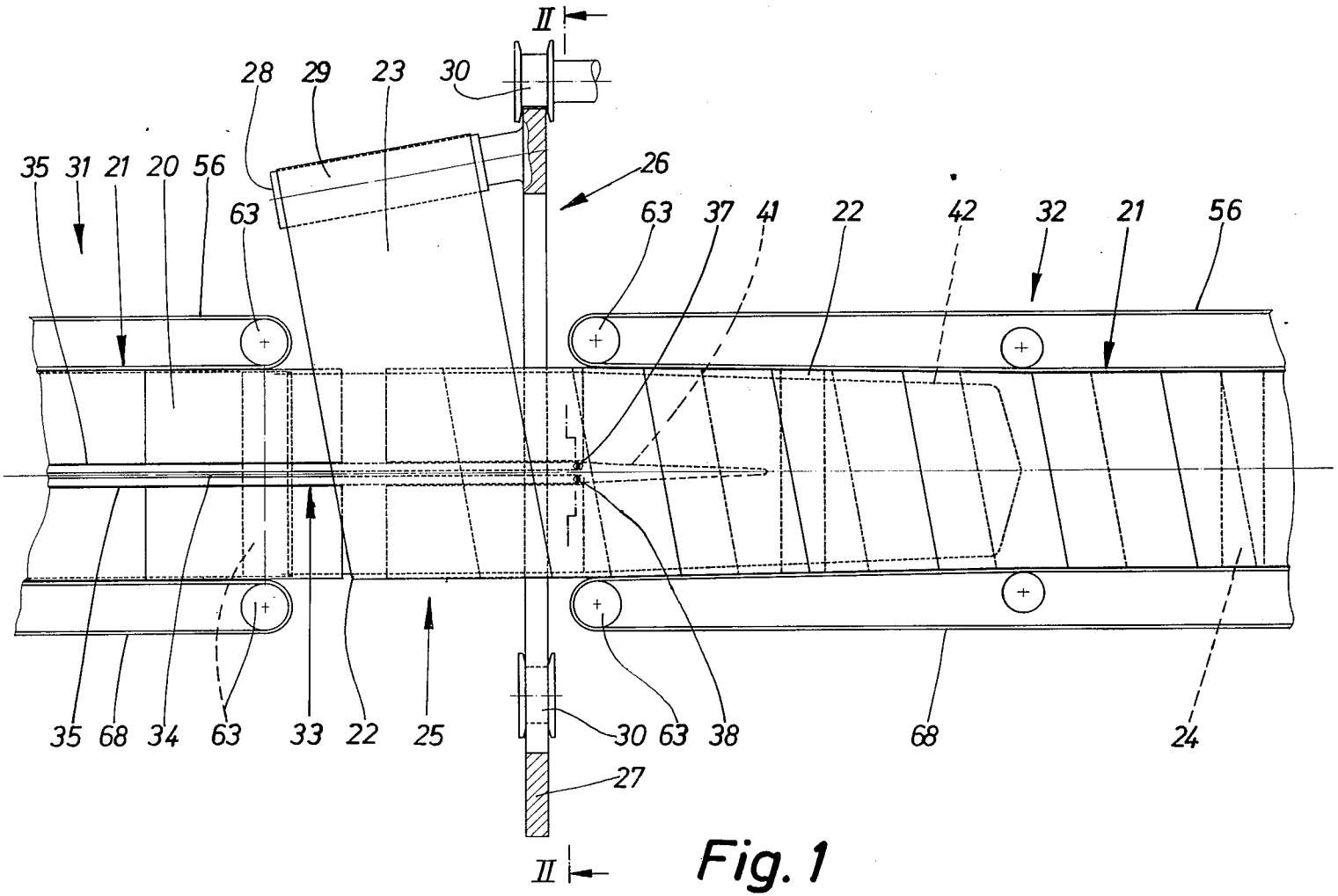
FIG. 1 shows a lateral view of an apparatus for wrapping articles, namely packages, partially in section.

The components and details shown in the drawings relate to apparatuses for wrapping articles, namely packages 20. These square structures are arranged in package groups 21, and arranged in a formation such that two or more packages 20 lie adjacent to one another or one above the other. A plurality of packages 20 can be arranged in succession in the conveying direction. The package groups 21 are conveyed inward with a space 22 from one another, are wrapped with a film web 23 and are conveyed outward with this distance 22 being maintained. The wound film web 23, in other words a wrapping 24 produced therefrom, is severed in the region of the space 22.

The film web 23 is wound around the package groups 21 in the region of the winding station 25 by a winding unit 26. In the exemplary embodiment shown, the winding unit 26 comprises a rotatably driven support ring 27, to which is fixed, on the rearward side with respect to the conveying direction, a journal 28 having an obliquely oriented axis of rotation for receiving a roll 29 of the film web 23. The support ring 27 is mounted on a plurality of support rolls 30, arranged separately. By rotation of the said support ring in a plane transverse to the conveying direction of the package groups 21, the film web 23 is wound around the continuously transported package groups 21 in a manner such that the edge regions of the film web 23 form overlaps. As a result the continuous wrapping 24 is produced.

The package groups 21 are conveyed to the winding station 25 by an inward conveyor 31. The inward conveyor 31 ends upstream of the winding region. In succession thereto, namely after production of the wrapping 24, the latter is received with the package groups 21 by an outward conveyor 32.

In the region of the winding station 25, namely between the end of the inward conveyor 31 and the start of the outward conveyor 32, the package groups 21 are carried and guided by a support member 33. This is arranged in the "inner region" of the package group 21, namely between mutually facing package sides. The support member 33 can be designed in a different manner. It primarily fulfills the function of holding the package group 21 together in the predetermined formation. It further serves to support the packages 20 as the support member in the region of the winding station 25. Finally, the support member 33 has a conveying function.

Figure 2:
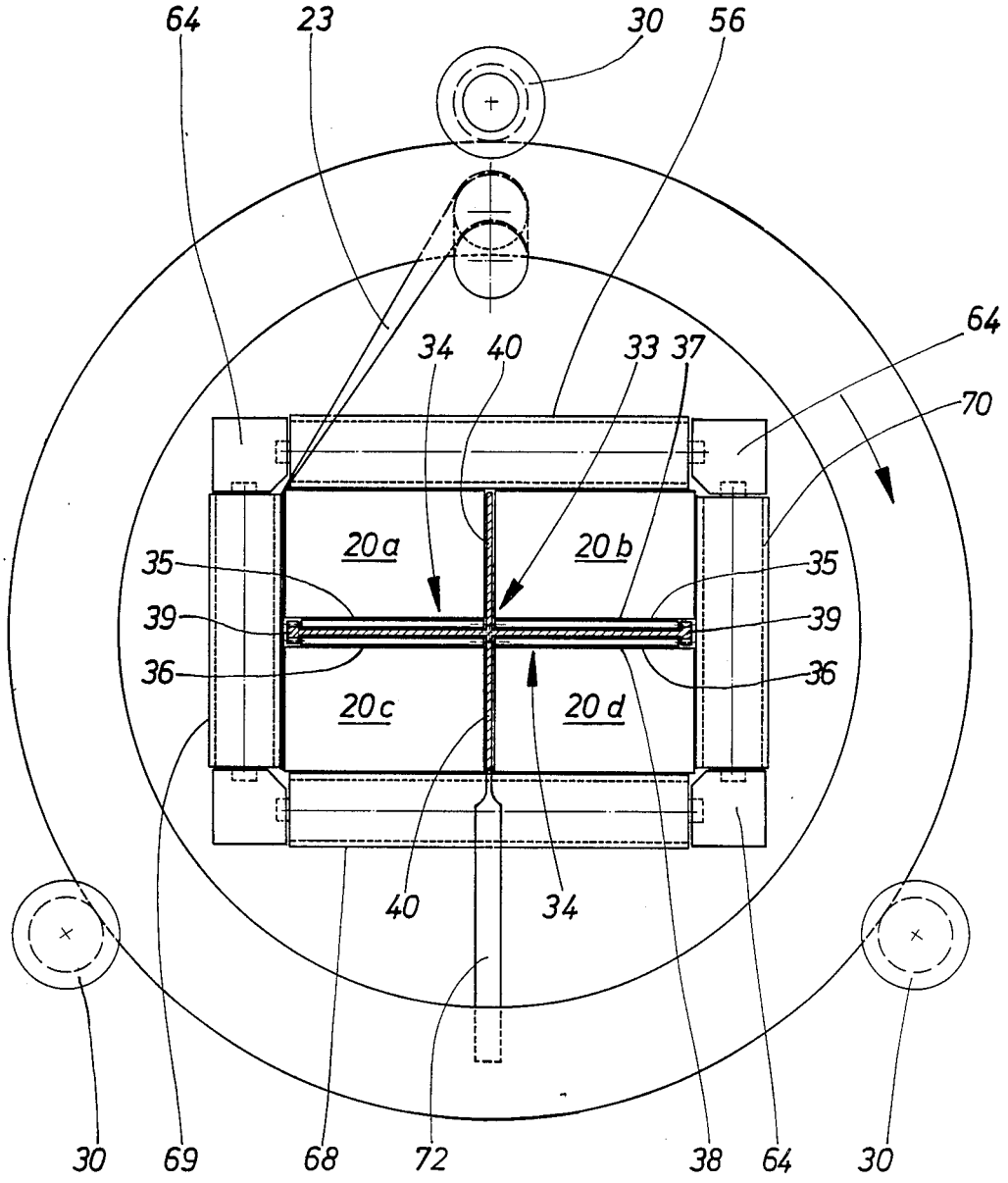
FIG. 2 shows a section in the plane II—II of FIG. 1.

In the exemplary embodiment according to FIGS. 1 and 2, the package group 21 consists of packages 20*a*, 20*b*, 20*c*, 20*d*. In the given formation, with two packages in each case adjacent to one another and one below the other, the support member 33 has the form of a cross in cross-section. A horizontally oriented support wall 34 delimits the upper packages 20*a*, 20*b* from the lower packages 20*c*, 20*d* and supports the upper ones. This support wall 34 is designed in a manner such that it simultaneously fulfills transport functions. For this purpose, the support wall 34 is provided on both sides, in other words above and below, with belt conveyors 35, 36 respectively. These extend, in the present exemplary embodiment, from the region of the inward conveyor 31 over the entire length of the winding station 25. The belt conveyors 35, 36 each run at their ends over deflection rollers 37, 38 of very small diameter. The deflection rollers 37, 38 are mounted by means of journals in lateral thickenings 39 of the support wall 34. An outer section of the belt conveyors 35, 36 in each case bears on a lower side or upper side respectively of the packages 20*a* . . . 20*d*.

The belt conveyors 35, 36 can be so designed that they run together "freely" with the (wrapped) package groups 21. To improve the conveying effect, however, it is advantageous to drive the belt conveyors 35, 36. The drive situated in the region of the inward conveyor 31 is not shown, for reasons of simplification.

The packages 20*a* and 20*c* on the one hand, and 20*b* and 20*d* on the other hand, lying adjacent to one another are delimited from one another by an upright support wall 40. This can be designed in the same manner as the horizontal support wall 33. In the present exemplary embodiment, however, the support wall 40 is adapted for the sliding contact of the packages 20*a* . . . 20*d* with the mutually facing lateral surfaces.

The action of the supporting member 33 thus formed is produced in connection with the substantial retaining power of the film web 23 or the wrapping 24 produced therefrom. On the one hand this exerts a substantial conveying action which extends also to the region of the winding station 25—by means of the outward conveyor 32. On the other hand, the packages 20 are pressed by substantial peripheral forces from the outside against the support member 33, namely against the support walls 34 and 40.

At the end of the winding station 25, the horizontal support wall 34 is, in the present exemplary embodiment, provided with an outlet end 41 which becomes thinner in the conveying direction. In the region of this transitional piece of the support wall 34, the packages 20*a*, 20*d* . . . are slowly guided together in a vertical direction until they are in contact with one another. The vertical support wall 40 is likewise provided with an outlet end 42 of this type, namely designed in the same way, but longer.

The exemplary embodiment of FIG. 3 to 9 is here adapted for package groups 21 comprising two packages 20*e*, 20*f* situated adjacent to one another. In this case the support member 33 comprises an upright support wall 43 between the packages 20*e*, 20*f*. The latter bear with their mutually facing lateral surfaces on this support wall 43.

In this embodiment, roller bodies are mounted in the support wall 43, the packages 20*e*, 20*f* bearing on these roller bodies. The latter are elongate, upright support rollers 44, which are arranged at a distance from one another in the conveying direction and are mounted offset. As is particularly apparent from FIG. 9, the support rollers 44 are mounted not in the vertical median plane of the support wall 43 but offset thereto, in a manner such that support rollers 44 bear alternately on one or the other package 20*e*, 20*f*. Each support roller 44 is accordingly allocated to one side or to one package 20*e*, 20*f*. The distance between the support rollers 44 is such that in any position of the packages 20*e*, 20*f* two or more support rollers 44 bear on one package.

In order to improve the conveying action, the support rollers 44 can be driven. In the present exemplary embodiment, the support rollers 44 are mounted to be freely rotatable in the upper bearing parts of the support wall 43, and are accordingly co-rotated by the advance of the packages 20e, 20f.

Figure 5:
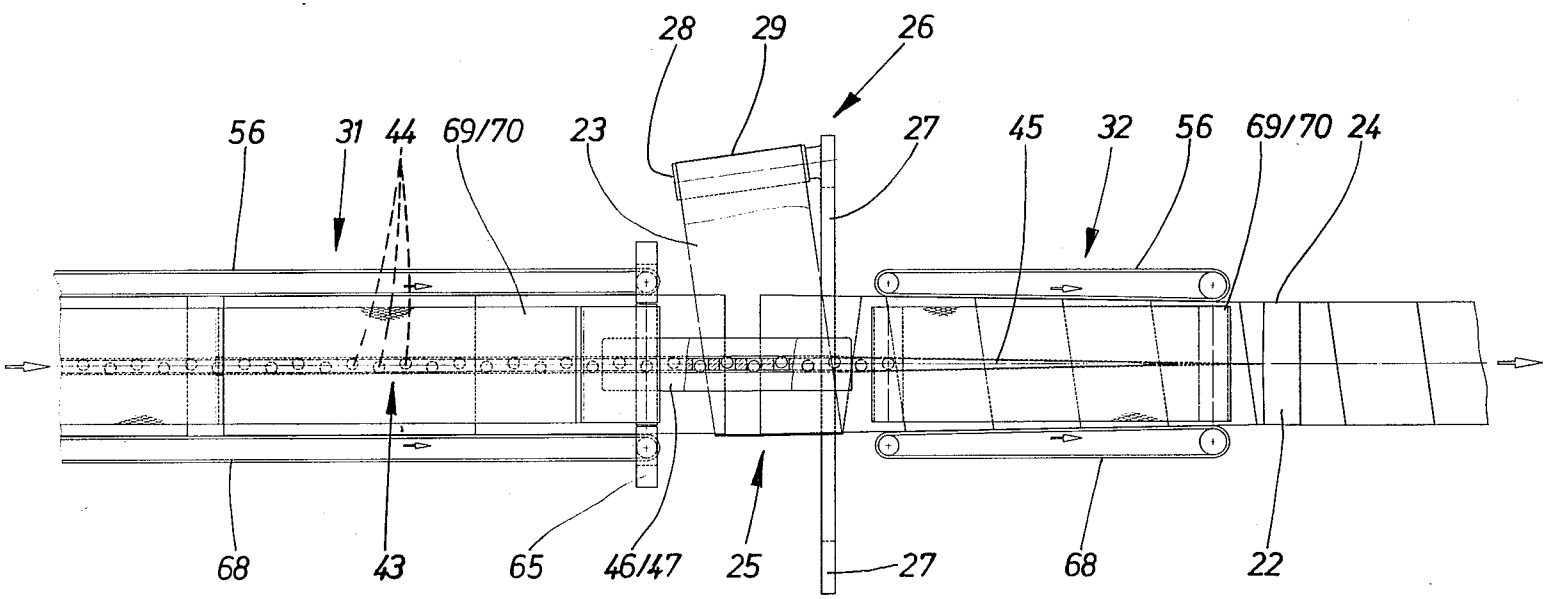
FIG. 5 shows a plan view of FIG. 3.
Figure 6:
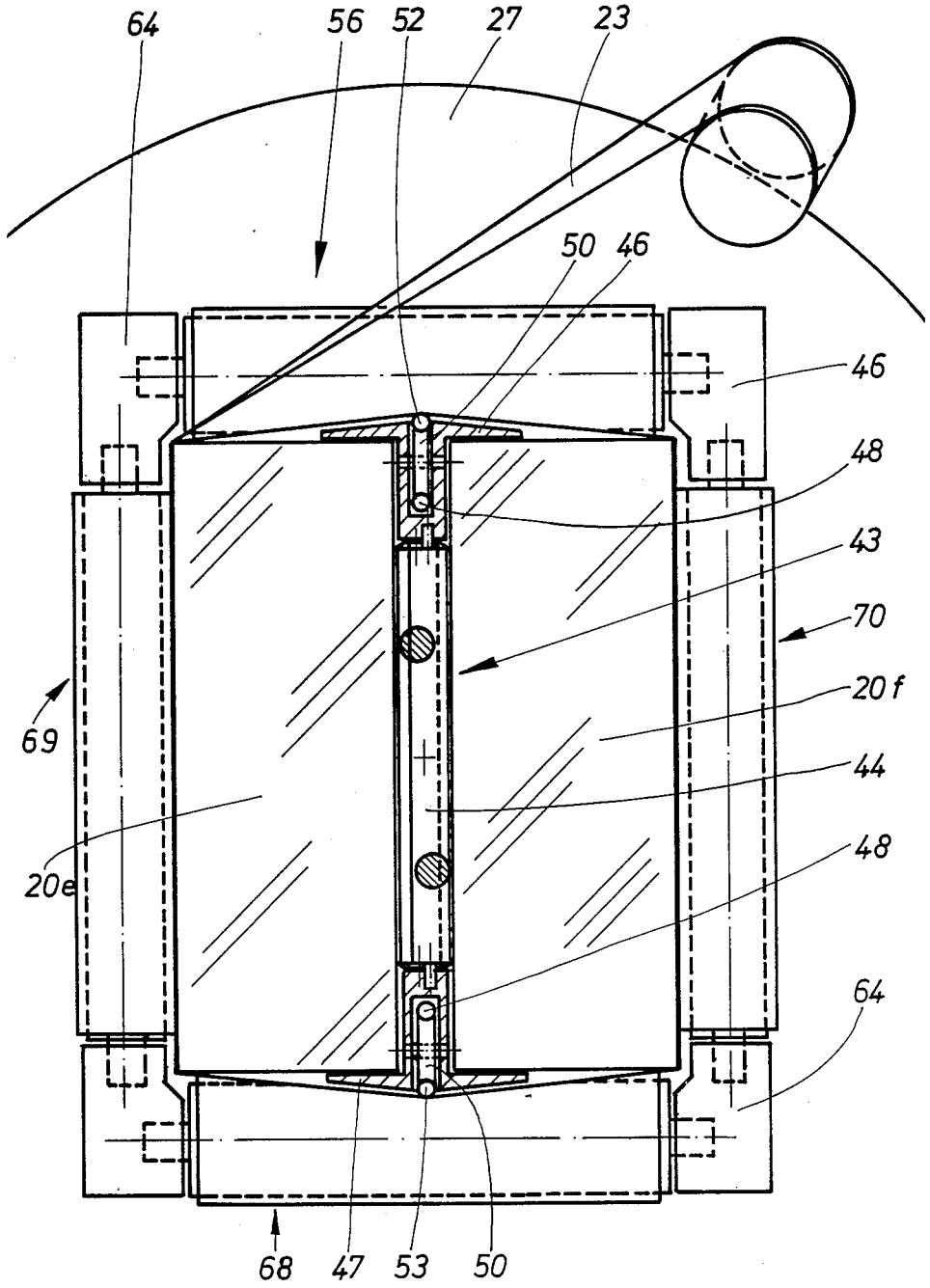
FIG. 6 shows a cross-section or a transverse view of the apparatus according to FIGS. 3 to 5 in the region of a winding unit.
Figure 7:
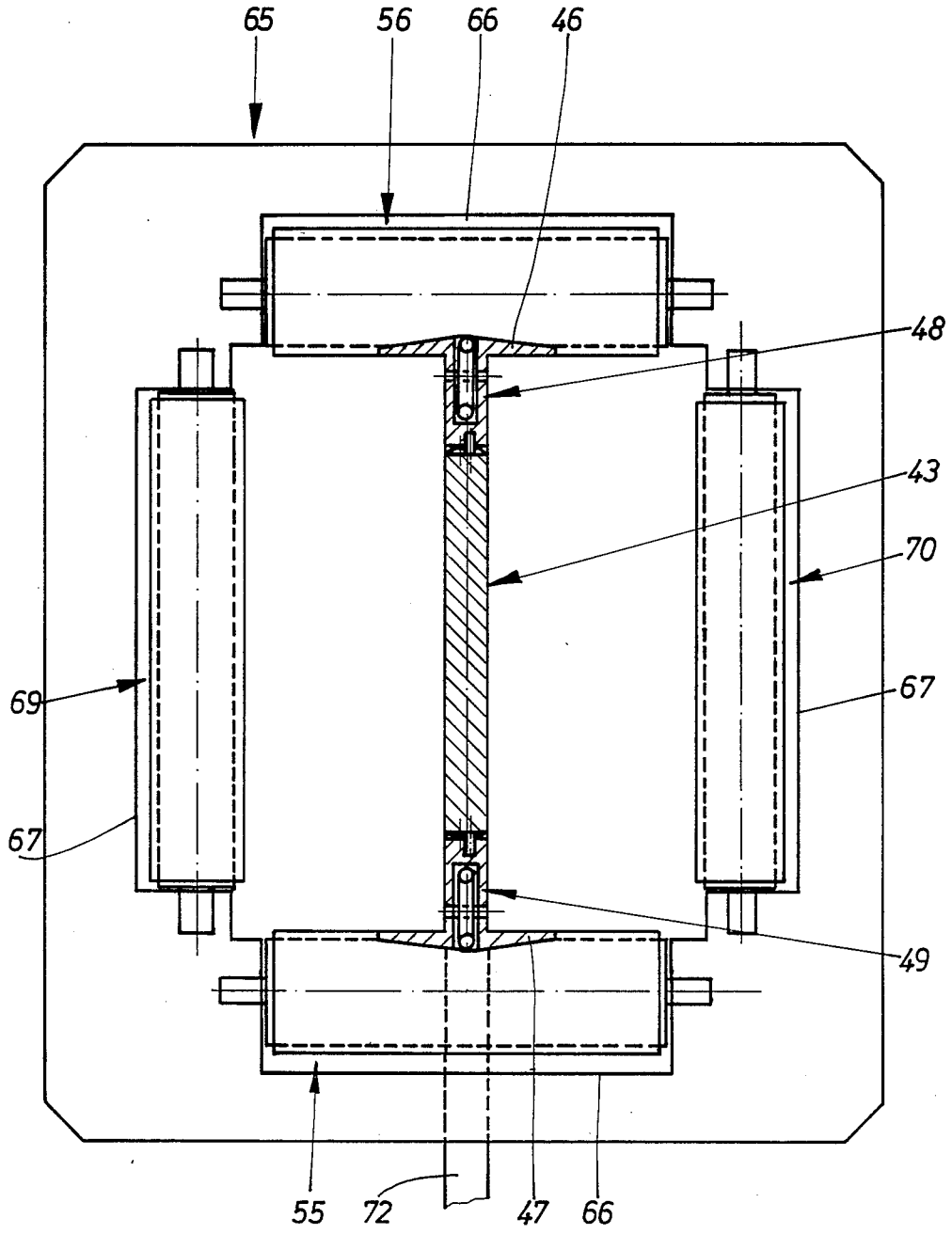
FIG. 7 shows a detail of the exemplary embodiment according to FIGS. 3 to 6 in cross-section or in transverse view.

As is apparent from FIG. 5, the support wall 43 extends in the region of the inward conveyor 31 and ends with an outlet end 45 of wedge-shaped design in the region of the outward conveyor 32. The latter is designed without support rollers 44.

In the exemplary embodiment described, the upright support wall 43 is provided at the upper and lower edges with transversely oriented support flanges 46, 47. The latter have a lesser width than the packages 20e, 20f or the package group 21. The packages 20e, 20f are thus supported only in a sub-region facing the support wall 43. In the conveying direction, the support flanges 46, 47 extend from the end region of the inward conveyor 31 over virtually the entire winding station 25.

The film web 23 or wrapping 24 clings to the support flanges 46, 47 below and above. In order to improve the transport effect, conveying members are installed in the region of the support flanges 46, 47 or in the upper and lower edge regions of the support wall 43, namely in each case a conveyor belt 48, 49 having an endless belt of rubber or a similar material. Deflection wheels 50 and support wheels 51 for this belt conveyor 48, 49 are mounted within the support wall 43, in a manner such that an upper or lower conveying section 52, 53 projects beyond the support flange 46, 47 so that the wrapping 24 bears on this conveying section 52, 53.

In order to facilitate the entry of the packages 20e, 20f into the region of the support flanges 46, 47, transition conveyors 54, 55 adjoin the inward conveyor 31 above and below. On the upper side, the transition conveyor 54 forms part of an upper belt conveyor, namely an upper conveyor 56, of the inward conveyor 31. The conveyor belts 48, 49 are driven by this upper conveyor 56 and by the lower transition conveyor 55, this drive taking place in the present case by frictional connection.

Figure 10:
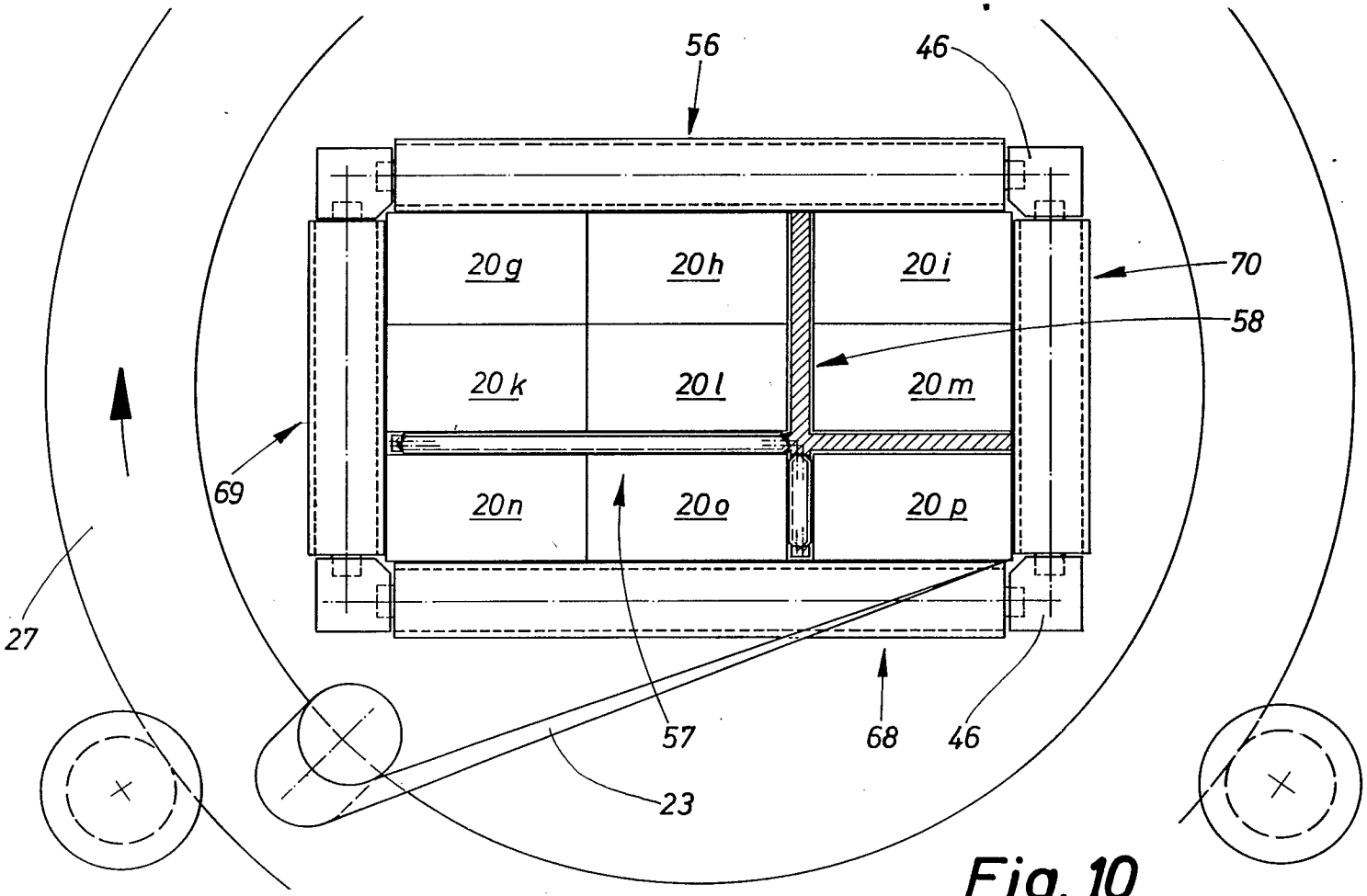
FIG. 10 shows a further exemplary embodiment of an apparatus in cross-section in the region of the winding unit.

FIG. 10 shows in cross-section of the apparatus a solution for designing the support member 33 in the case of more than four packages 20 in a package group 21. The support member 33 here has an asymmetrical cruciform design with a horizontal support wall 57 and a vertical support wall 58. The horizontal support wall 57 is arranged in a manner such that in each case two packages, 20g, 20k and 20h, 20l and 20i, 20m, respectively bear on the latter. Below the horizontal support wall 57, packages 20n, 20o, 20p are positioned adjacent to one another. The upright support wall 58 is arranged analogously thereto.

The design of the support walls 57, 58 can correspond to the exemplary embodiments described. FIG. 10 shows a solution having support rollers 44 in the region of the support walls 57, 58. The arrangement here is such that each leg of the support walls 57, 58 possesses support rollers 44 of corresponding length.

Figure 11:
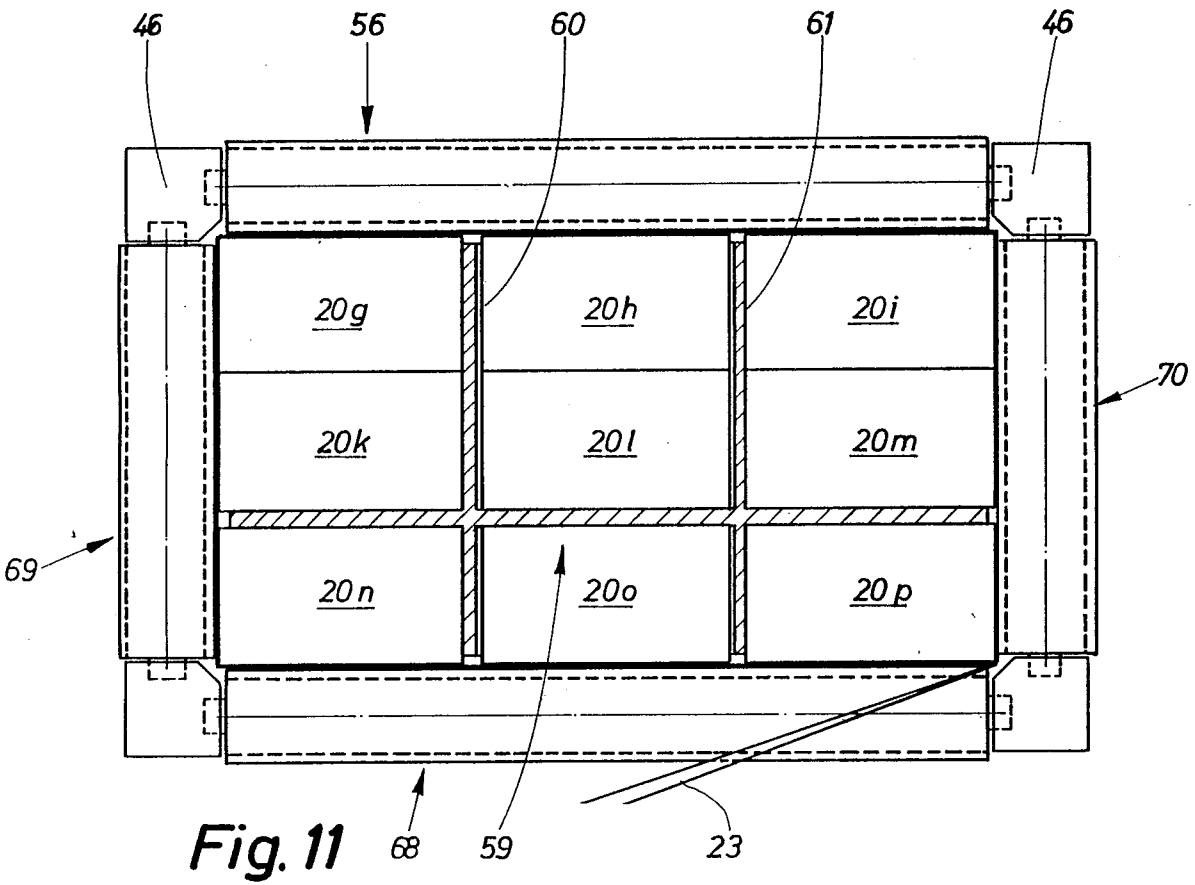
FIG. 11 shows an illustration according to FIG. 10 for a further exemplary embodiment.

A further alternative for the design of the support member 33 is shown in FIG. 11—again in cross-section of the winding station 25. Here again, it is necessary to handle a package group 21 comprising nine packages 20g . . . 20p. The support member 33 consists in this case of a continuous horizontal support wall 59 and two vertical support walls 60 and 61. In the transverse direction, accordingly, the packages are always separated from one another by upright support walls 60, 61. The horizontal support wall 59 bears in each case two packages 20g, 20k; 20h, 20l; 20i, 20m lying one above the other.

The design of the support walls 59, 60, 61 can correspond to the exemplary embodiments described. In FIG. 11, however, a further fundamental solution for the design of support walls is shown, namely with exclusive frictional contact with the packages. These are accordingly conveyed slidingly along the support walls, on or against the latter. The dimensions of the vertical support walls 60, 61 are such, or their distance from one another is so arranged, that the middle packages 20h, 20l and 20o respectively are transported without contact with the upright support walls 60, 61. A narrow gap is formed relative to the support walls 60, 61.

Inward conveyor 31 and outward conveyor 32 can likewise be designed in a different manner, in order to feed the package groups 21 while maintaining the formation and to convey them outwards with the wrapping 24.

In the exemplary embodiments shown, the inward conveyor 31 consists of belt conveyors, namely a lower conveyor 68, on which the package groups 21 rest, of the upper conveyor 56 already mentioned and lateral conveyors 69 and 70, which are likewise belt conveyors. The abovementioned belt conveyors are driven, at least in some cases. An inward-lying section in each case bears on lateral or upper and lower surfaces of the packages 20.

Figure 3:
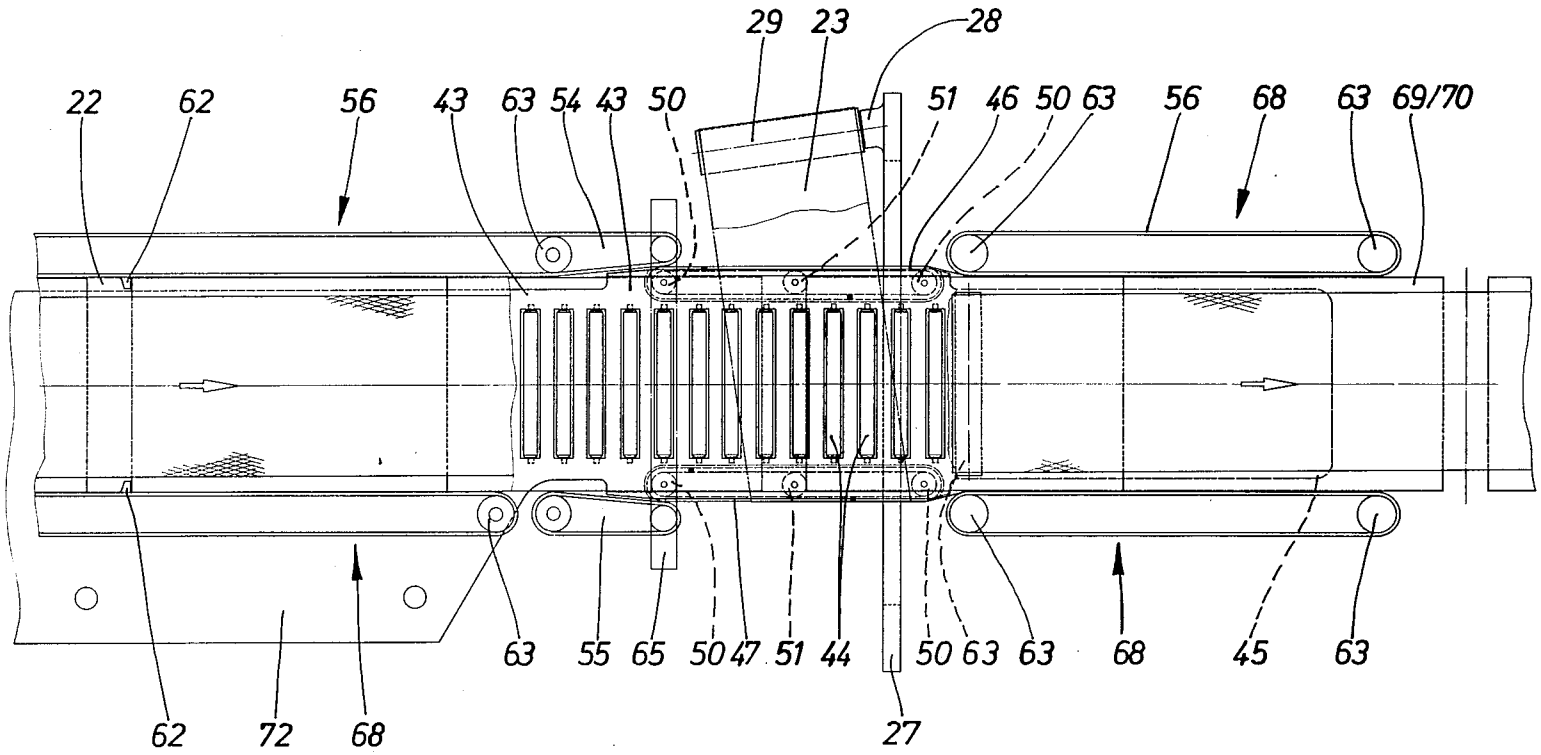
FIG. 3 shows a lateral view of another exemplary embodiment of an apparatus for wrapping articles.
Figure 4:
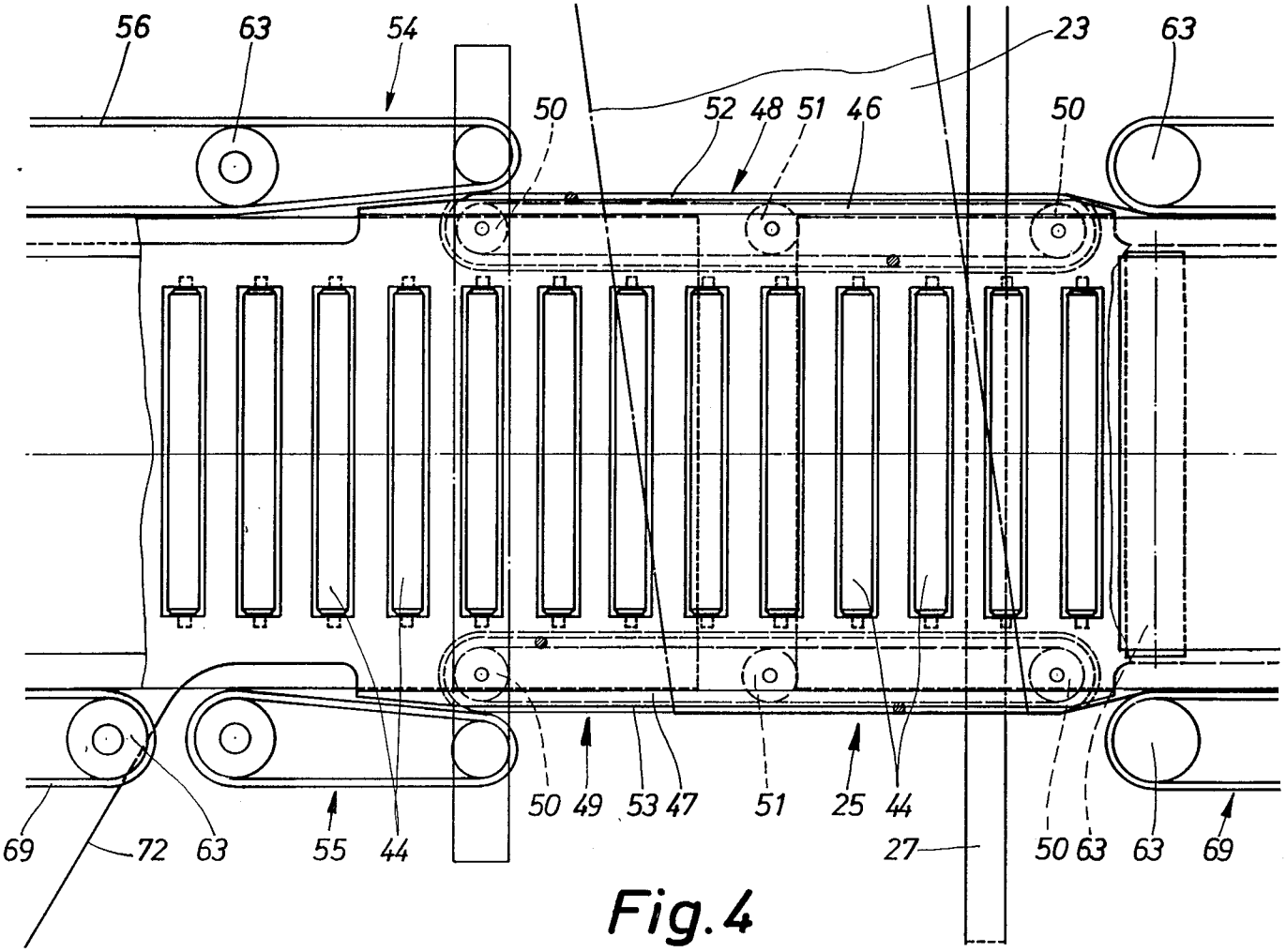
FIG. 4 shows a section of the illustration according to FIG. 3 on a larger scale.

As shown for example in FIG. 3, it is advantageous if the inward conveyor 31 or at least the lower conveyor 68—but, in the exemplary embodiment of FIG. 3 illustrated, also the upper conveyor 56—possesses molded-on entraining devices 62 which each grip the rear side of one package group 21. The distances between the entraining devices 62 are of dimensions such that the package groups 21 are conveyed at the desired distance 22 from one another.

Deflection rollers 63 of the belt conveyors of the inward conveyor 31 are rotatably mounted in stationary bearing components 64 by means of bearing journals. A particularly advantageous embodiment is the one shown as a detail in FIG. 7. A closed, stationary supporting frame 65 is provided in order to mount the deflection rollers 63 of four belt conveyors (upper conveyor 56, lower conveyor 68, lateral conveyors 69 and 70). In the region of the frame legs this is provided with recesses 66, 67 in which the belt conveyors are rotatably mounted by means of their deflection rollers 63.

The outward conveyor 32 is designed in a similar manner, that is to say likewise with upper, lower and lateral belt conveyors, in other words an upper conveyor 56, a lower conveyor 68 and lateral conveyors 69 and 70.

Figure 8:
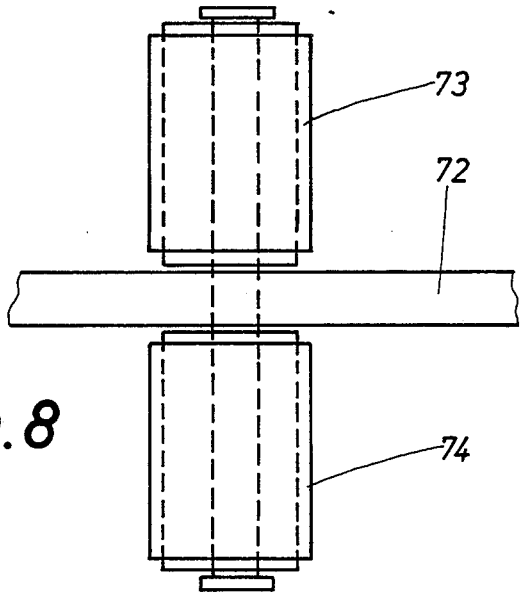
FIG. 8 shows a further detail of the exemplary embodiment according to FIGS. 3 to 7 on an even larger scale.
Figure 9:
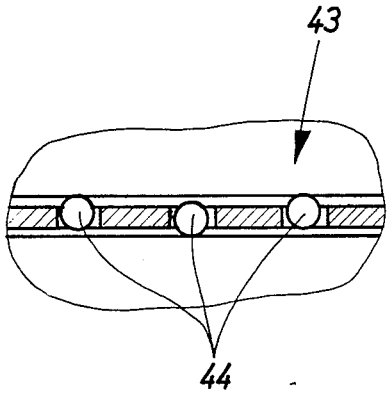
FIG. 9 shows a horizontal section in the region of a support wall of the apparatus according to FIGS. 3 to 8.

The support member 33 is fixedly anchored outside the region of the winding station 25, in a manner such that the entire support member 33 projects like a jib into the winding station 25. In the exemplary embodiment shown, an upright support wall 40, 43, 58, 60 and/or 61 is intended in each case to anchor the support member 33. For this purpose, as described, at least the support wall intended for anchoring projects into the region of the inward conveyor 31. An anchoring attachment 72, oriented to the side and downwards respectively, is fixedly anchored in a suitable manner to a machine frame or the like. The belt conveyor in question is of split design for the passage of the anchoring attachment 72, and accordingly consists of two conveyor sections 73 and 74, as shown in FIG. 8.

What is claimed is:

1. An apparatus for encasing articles in a wrapping from a film web which, during the advance of the articles, is passed around the articles with overlapping of the web's edges, said apparatus comprising:

a winding unit for wrapping the film web around the articles;

an inward conveyor (31) for feeding the articles, as article groups (21) comprising two or more articles (20) arranged adjacent to one another, to said winding unit; said winding unit having a stationary support member (33) for the articles; and an outward conveyor (32) for transporting the wrapped article groups with continuous wrapping;

wherein said outward conveyor is located downstream of the winding unit, and wherein said support member (33) supports the articles of an article group (21) between mutually facing article surfaces in the region of the winding unit.

2. The apparatus as claimed in claim 1, wherein the support member (33) is a conveying member.

3. The apparatus as claimed in claim 1 or 2, wherein the support member (33) possesses, on the sides facing the articles (20), conveyor members, in the form of belt conveyors (35, 36) and support rollers 44, bearing on the articles (20).

4. The apparatus as claimed in claim 3, wherein the width of a belt conveyor (35, 36) approximately corresponds to the dimension of a facing side of the articles (20).

5. The apparatus as claimed in claim 1, wherein, in the case of two adjacent articles (20), said support member (33) has a support wall (43) extending between the articles.

6. The apparatus as claimed in claim 5, wherein the support wall (43) possesses, on upper, lower and lateral edges, thereof transversely extending support flanges (46, 47) which bear on upper, lower and lateral surfaces of the articles (20).

7. The apparatus as claimed in claim 1, wherein said support member comprises a support wall (43) having free edges which contain conveying means for the film web (23), said conveying means comprising a driven entraining belt running with the film web in the conveying direction.

8. The apparatus as claimed in claim 1, wherein, in the case of an article group (21) comprising two articles (20) arranged adjacent to one another and one above the other, the support member (33) is a cruciform in cross-section, having a horizontal support wall (34) and a vertical support wall (40).

9. The apparatus as claimed in claim 1, wherein, in the case of more than two articles (20) adjacent to one another and one above the other, the support member (33) comprises intersecting support walls (57, 58) arranged offset relative to one another, in a manner such that a plurality of articles (20) one above the other rest on a horizontal support wall (57).

10. The apparatus as claimed in claim 1, wherein, in the case of a corresponding number of articles (20) per article group (21), the support member (33) comprises a plurality of vertical support walls (60, 61) with or without a plurality of horizontal support walls (59).

11. The apparatus as claimed in claim 1, wherein, in the case of a support member (33) comprising a plurality of horizontal and vertical support walls, only the horizontal support walls (34), possess conveying members 35, 36; 44).

12. The apparatus as claimed in claim 1, wherein support walls (34) of the support member (33) are provided on both sides with belt conveyors (35, 36).

13. The apparatus as claimed in claim 1, wherein support walls (43; 57, 58) of support member possess support rollers (44) rotatably mounted in each support wall, adjacent support rollers (44) being arranged offset relative to one another in a manner such that support rollers (44) in each case bear alternately on one or another article (20).

14. The apparatus as claimed in claim 1, wherein the support member (33) extends into the region of said inward conveyor (31) for the article groups (21) and into the region of said outward conveyor (32) for article groups (21) and wrapping (24), support walls of said support member being provided, in the region of the outward conveyor (32), with a converging outlet end (41, 42).

15. The apparatus as claimed in claim 1, wherein the support member (33) is mounted on one side in the region of inward conveyor (31) and extends as a jib to a winding station (25) containing said winding unit.

16. The apparatus as claimed in claim 15, wherein an upright support wall (40) is provided, in the region of a lower conveyor (68) of the inward conveyor (31), with a guided anchoring attachment (72) for attaching the support member (33) to a machine frame, the lower conveyor (68) being divided for the passage of the anchoring attachment (72) and comprising two conveyor sections (73, 74) arranged at a distance from one another.

17. The apparatus as claimed in claim 1, wherein said support member (33) comprises two upright support walls (60, 61) spaced apart by a distance greater than the width of the articles (20), in a manner such that the articles are conveyed without contact between the support walls (60, 61).

* * * * *